United States Patent [19]

Quiogue

[11] 4,286,313

[45] Aug. 25, 1981

[54] BALANCED INDUSTRIAL LUMINAIRE

[75] Inventor: Honesto D. Quiogue, Blacksburg, Va.

[73] Assignee: Harvey Hubbell Incorporated, Orange, Conn.

[21] Appl. No.: 66,814

[22] Filed: Aug. 15, 1979

[51] Int. Cl.[3] ..... F21V 21/00

[52] U.S. Cl. ..... 362/370; 362/368; 362/404

[58] Field of Search ..... 362/370, 368, 404

[56] References Cited

U.S. PATENT DOCUMENTS

| | | | |
|---|---|---|---|
| 2,347,113 | 4/1944 | King | 248/343 |
| 3,551,667 | 12/1970 | Husby | 240/3 |
| 3,643,088 | 2/1972 | Osteen et al. | 240/52 |
| 4,186,433 | 1/1980 | Baldwin | 362/404 |

*Primary Examiner*—Stephen J. Lechert, Jr.
*Attorney, Agent, or Firm*—Jerry M. Presson

[57] ABSTRACT

An industrial luminaire comprising a central housing formed of two identical parts, a capacitor cover pivotally coupled to one side of the housing having a capacitor therein, a ballast and ballast cover on the other side of the housing, a lamp socket coupled to the bottom of the housing, and a top cover pivotally coupled to the top of the housing. Separation of the capacitor and the ballast from the heat generating lamp provides longer life and higher efficiency for these components. The pivotal coupling of the top cover and the capacitor cover provide for easy access during maintenance. The top cover is coupled to a fixed overhead support over the center of gravity of the entire structure providing a balanced, reduced stress connection.

14 Claims, 8 Drawing Figures

BALANCED INDUSTRIAL LUMINAIRE

FIELD OF THE INVENTION

The present invention relates to an industrial luminaire coupled to an overhead fixed support over the center of gravity of the entire luminaire structure to provide a balanced connection therefor. The capacitor and ballast are separated from the heat generating lamp to provide longer life and higher efficiency. Various components are pivotally coupled to the central housing for ease of installation and access during maintenance.

PRIOR ART

Many types of industrial luminaires are known for supporting heavy-duty lamps of the mercury, metallic halide or high pressure sodium type. Many of these devices are complicated in construction and, being somewhat heavy, require complex and large mounting mechanisms for supporting the luminaire in the appropriate place. In addition, in many of these devices expose the ballast and the capacitor to the heat generating lamp, which reduces the life and efficiency of these components. Also, many of these devices are quite large and thereby provide an undesirable appearance. Moreover, many of these devices are difficult to maintain since they must be completely removed from the supported position to gain access to the internal components. An example of one of these prior art devices is shown in U.S. Pat. No. 3,643,088 issued on Feb. 15, 1972, to Osteen et al which discloses a balanced luminaire support with the optical assembly mounted in an offset relation to the associated ballast housing, but the resulting luminaire takes up a large amount of space. The disclosure of U.S. Pat. No. 2,347,113 issued on Apr. 18, 1944 to King also provides an offset supporting structure; however, it requires a very strong support mechanism. An example of one of the prior art devices having the ballast adjacent to the heat generating lamp is disclosed in U.S. Pat. No. 3,551,667, issued on Dec. 29, 1970 to Husby.

SUMMARY

Accordingly, it is a primary object of the present invention to provide a luminaire which is coupled to an overhead support to provide a balanced connection, thereby providing correct orientation of the light given off by the lamp and a reduced stress on the connection.

Another object of the present invention is to provide a luminaire which isolates the capacitor and ballast from the heat generating lamp to provide longer life and higher efficiency to these components.

Another object of the present invention is to provide a luminaire formed from a plurality of simply formed components which is compact.

Another object of the present invention is to provide a luminaire having various components pivotally coupled to the central housing for ease of access during maintenance.

The foregoing objects are basically attained by providing a luminaire assembly comprising a central housing having a lamp socket extending downwardly therefrom; a capacitor; first means for mounting said capacitor on one side of said housing and externally thereof; a ballast; second means for mounting said housing opposite said capacitor with a major portion of said ballast being outside of said housing; a top cover having means at one side thereof for suspending said assembly from a fixed support; means for coupling said top cover to the top of said housing with said means for suspending positioned off center toward said ballast so that said means for suspending engages the fixed support substantially vertically aligned with the center of gravity of said assembly.

By separating the capacitor and the ballast from the heat generating lamp, these components are provided with a longer life and a higher efficiency. By pivotally coupling the top cover and the capacitor cover to the central housing, easy access during maintenance of the luminaire is provided. And by coupling the top cover to the fixed overhead support over the center of gravity of the entire structure, a balanced, reduced stress connection of the entire structure is provided.

Other objects, advantages and salient features of the present invention will become apparent from the following detailed description, which, taken in conjunction with the annexed drawings, discloses a preferred embodiment of the present invention.

DRAWINGS

Referring now to the drawings which form a part of this original disclosure:

DETAILED DESCRIPTION

Figure 1:
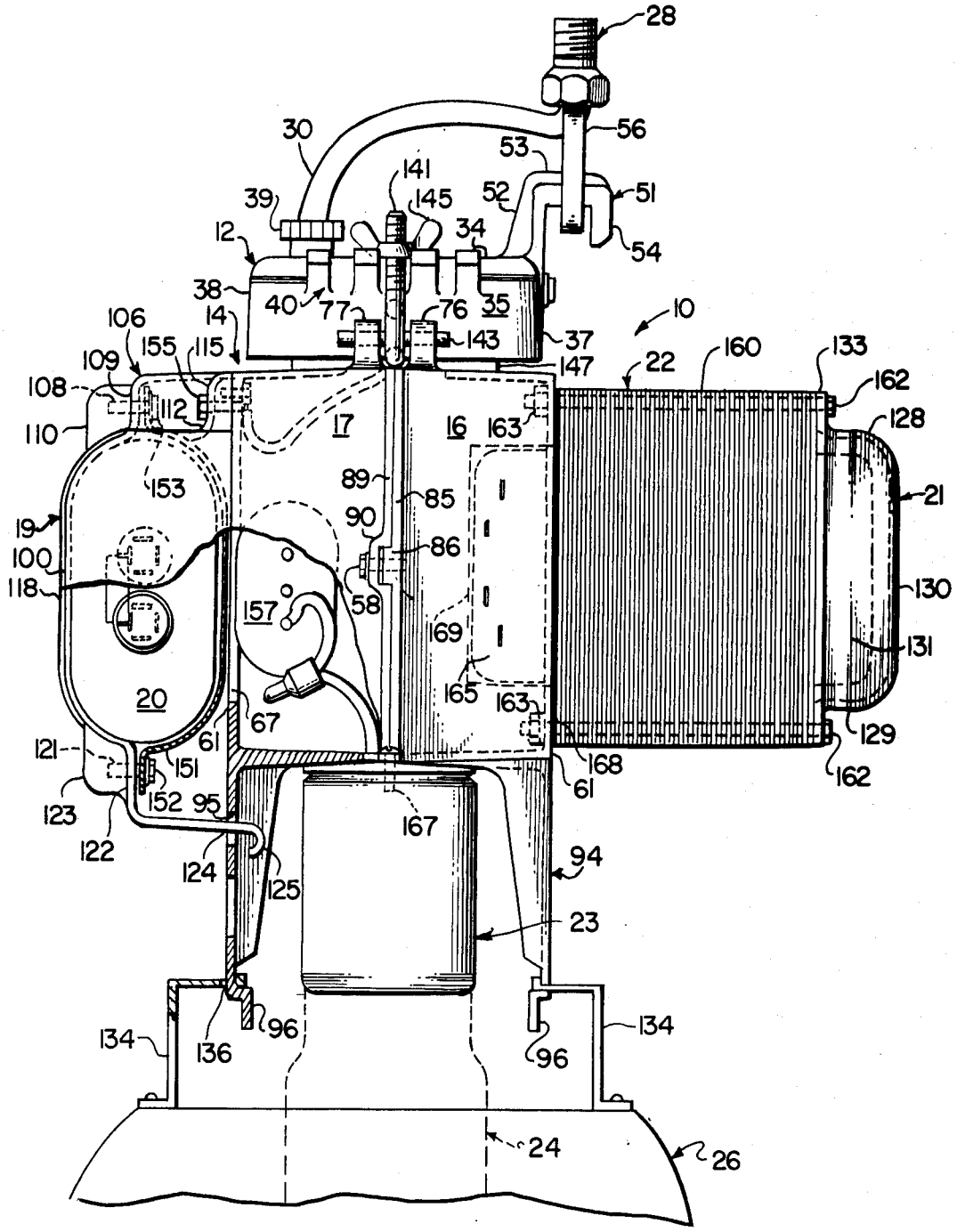
FIG. 1 is a front elevational view with portions cut away of the luminaire in accordance with the present invention.

Referring now to the drawings in further detail, the luminaire 10 in accordance with the present invention comprises a top cover 12, a central housing 14 formed of two identical parts 16 and 17, a capacitor cover 19, a ballast cover 21, a lamp socket 23 having a lamp 24 therein and a reflector 26. The luminaire is supported on a flexible or rigid overhead conduit shown in FIG. 1 as fixed support 28. The luminaire includes a capacitor 20 and a ballast 22.

A power cable 30 extends from the interior of the hollow conduit forming support 28 into the top cover 12 which serves as a splicing box to convert the wires in the cable to those wires which are in the central housing and which provide electrical power to the luminaire.

Referring now to FIGS. 1, 2, 5 and 6, the top cover, which is preferably formed of cast aluminum, comprises a rectangular top wall 34 and four depending walls including a first end wall 35, a second end wall 36, a first side wall 37 and a second side wall 38.

Figures 2, 8:
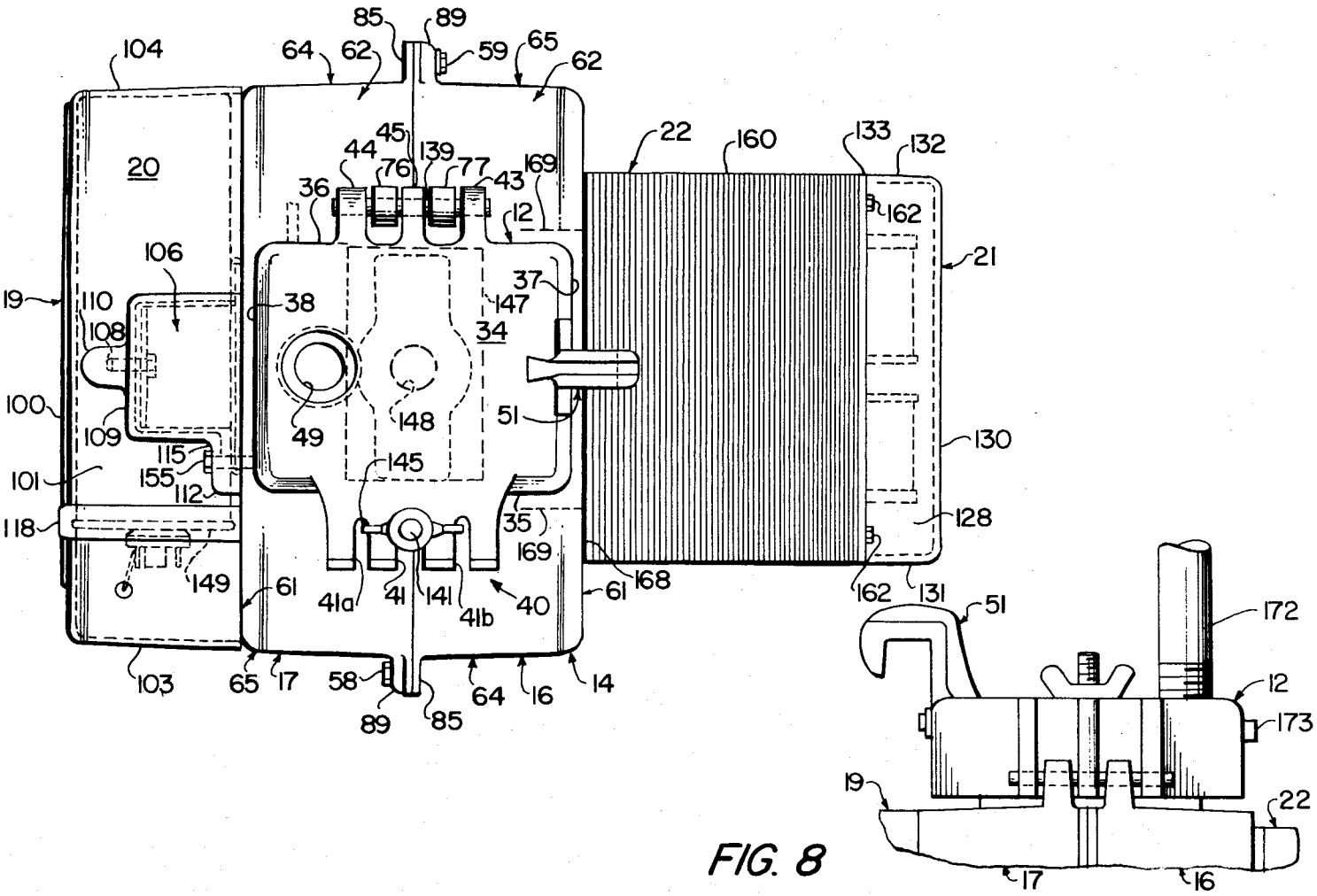
FIG. 2 is a top plan view of the luminaire shown in FIG. 1.
FIG. 8 is a fragmentary front elevational view of an alternate mounting for the luminaire.
Figure 3:
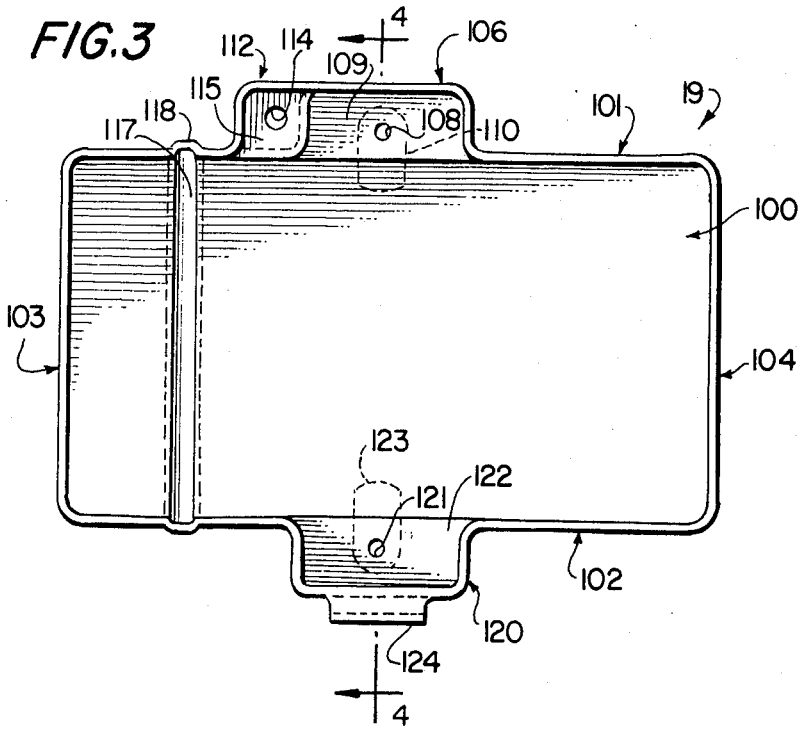
FIG. 3 is a right side elevational view of the inside of the capacitor cover.
Figure 6:
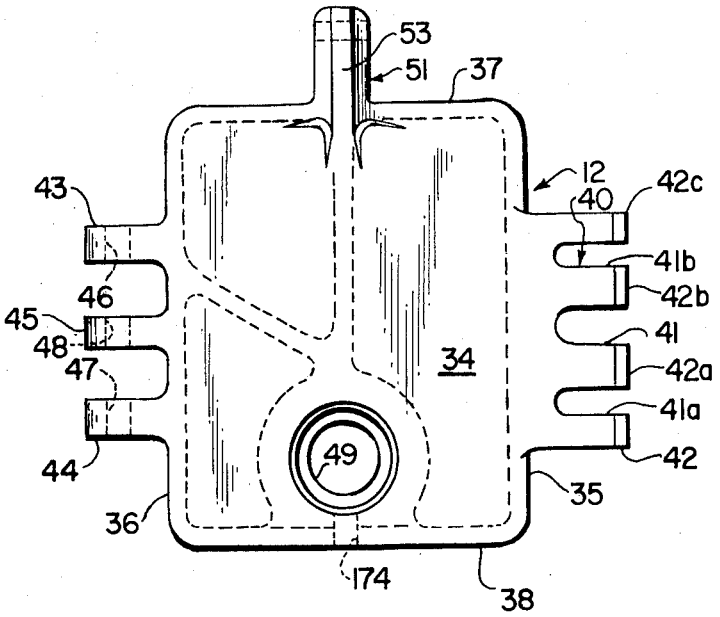
FIG. 6 is a top plan view of the top cover shown in FIG. 5.

A forked bracket 40 extends outwardly from the center of the first end wall 35 near its top, this bracket having three slots 41, 41*a* and 41*b* defined by the four spaced bracket elements 42, 42*a*, 42*b* and 42*c* as seen in FIGS. 1, 2, and 6.

Figure 5:
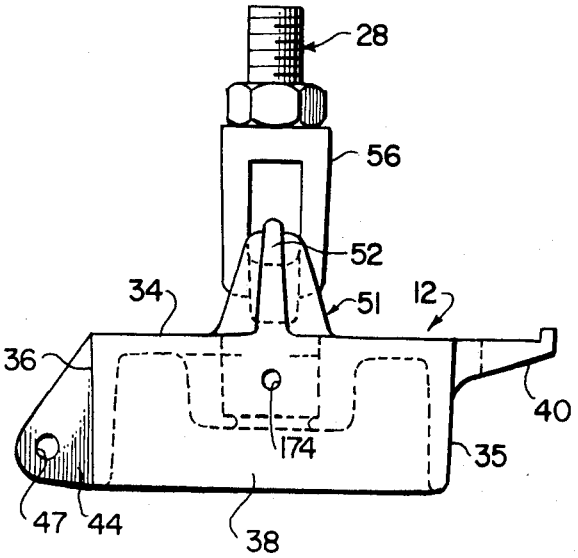
FIG. 5 is a left side elevational view of the top cover and the fixed support for the luminaire.

On the opposed second end wall 36 there are three spaced flanges 43, 44 and 45, as seen in FIGS. 2, 5 and 6, having respectively therein horizontal coaxially aligned bores 46, 47 and 48.

Figure 7:
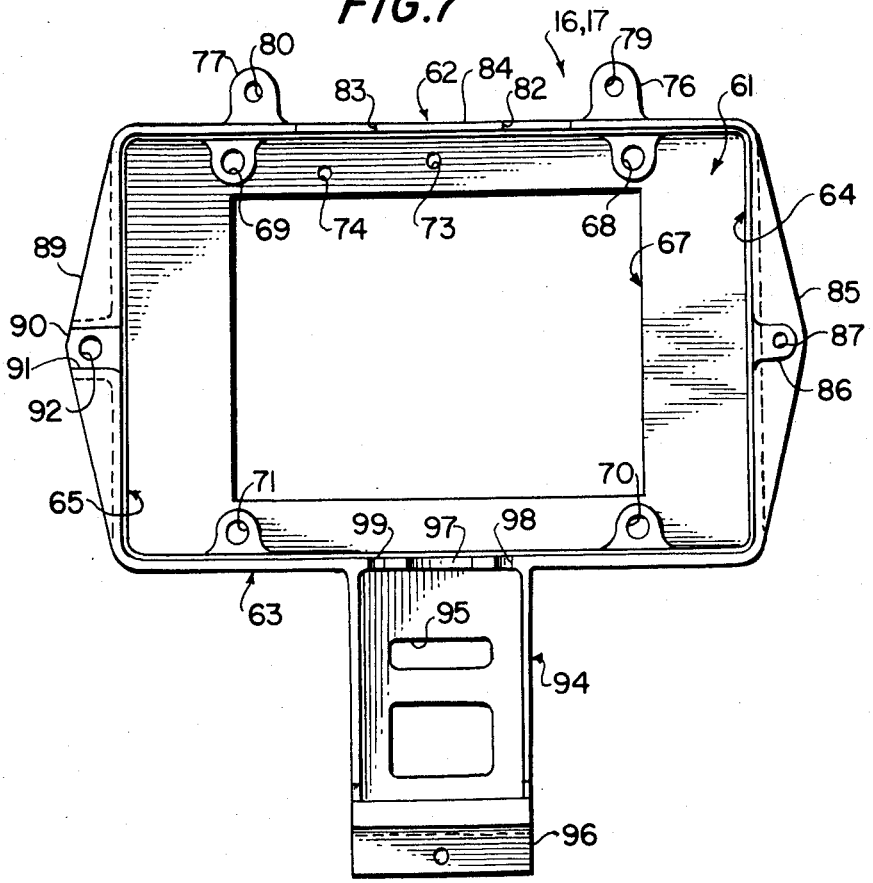
FIG. 7 is an elevational view of the inside of the two identical parts forming the central housing of the luminaire.

As seen in FIGS. 2 and 7, the top wall 34 of the top cover has a threaded aperture 49 therein adjacent the second side wall 38 and centered between walls 35 and 36 for the reception of the power cable 30 shown in FIG. 1. The cable is guided into the aperture through a threaded knurled guide 39.

Opposed to aperture 49 at the intersection of the top wall 34 and the first side wall 37 is downwardly opening hook 51 having, as seen in FIG. 1, an upwardly, vertically extending base portion 52, a horizontally, outwardly extending support portion 53 and a downwardly, vertically extending distal portion 54. This hook 51 is pivotally supported in eye or loop 56 suitably supported at the bottom of threaded conduit 28 which can be threaded into a fixedly mounted internally threaded member. Thus, loop 56 becomes a fixed support. This pivotal coupling is over the center of gravity of the entire luminaire so that the suspension of the luminaire provides a balanced connection of reduced stress. A fine "tuning" of the balancing for the luminaire can be accomplished by selectively coupling the top cover to the housing by use of the bracket elements and the flanges on the top cover. This takes into account the differing weights of presently available ballasts of varying sizes.

The central housing 14 is shown in FIGS. 1 and 2 as comprising two identical parts 16 and 17 which are coupled together by means of screws 58 and 59. Since these two parts or halves of the central housing are identical, corresponding portions thereof are given the same reference numerals as seen in FIG. 7 which shows the inside of each identical part 16, 17.

Thus, as seen in FIG. 7, the two parts each comprise a side wall 61, a top wall 62, a bottom wall 63, a first end wall 64 and a second end wall 65.

The side wall 61 has a rectangular, central aperture or cut out 67 and four bores 68, 69, 70 and 71 adjacent the four corners of the rectangular central aperture 67, with the two top bores being adjacent the top wall 62 and the two bottom bores being adjacent the bottom wall 63. Centrally located between bores 68 and 69 between the top of central aperture 67 and the top wall 62 is an additional bore 73 and located between bore 73 and bore 69 is another bore 74.

On the top wall 62 are two spaced brackets 76 and 77 located respectively substantially above and between bores 68 and 69. These brackets 76 and 77 each have respectively a horizontal bore 79 and 80 therein. In between these brackets on the top wall 62 are formed two spaced rectangular recesses 82 and 83 with a semicircular recess 84 therebetween which, when the two parts 16 and 17 are connected, form a passageway allowing electrical wires or cables to pass into the internal cavity defined by central housing.

The first end wall 64 has a perpendicular flange 85 extending from its distal edge, this flange having a horizontally extending, central projection 86 with a horizontal bore 87 therein.

The second end wall 65 has a similar flange 89 extending outwardly from its distal edge having a horizontally extending projection 90 in the middle thereof extending towards the side wall 61 and having a recess 91 internally formed therein for the reception of the projection 86 on the identical other half of the central housing. This recessed projection 90 has a horizontal bore 92 therein.

As seen in FIGS. 1 and 7, the bottom wall 63 has a leg 94 extending downwardly from the center thereof, the leg being somewhat channel shaped in cross-section with an elongated aperture 95 horizontally oriented in the main portion of the channel shaped leg 94. At the bottom of leg 94 is an inverted L-shaped projection 96. Formed in the bottom wall 63 inside the area defined by leg 94 is a central semi-circular recess 97 and two smaller semi-circular recesses 98 and 99 on opposed sides of the recess 97.

As seen in FIGS. 1 and 2, the two identical parts 16 and 17 mate together with the two projections 86 in flanges 85 respectively being received in the recesses 91 in the two projections 90 in flanges 89. Screws 58 and 59 pass through bores 92 and are threadedly engaged in internally threaded bores 87.

As seen in FIGS. 1, 2, 3 and 4, the capacitor cover 19 has a side wall 100, a top wall 101, a bottom wall 102, a first end wall 103, and a second end wall 104.

Centrally located in the top wall 101 is an upper protruding chamber 106 having a rectangular longitudinal and transverse cross-section extending about two-thirds the width of top wall 101 and having an internal threaded bore 108 in a vertical wall 109 thereof, which bore extends into an integrally formed flange 110 on the outside of the vertical wall 109. Adjacent chamber 106 is a smaller chamber 112 having a similar cross-section and having a bore 114 in the outside vertical wall 115 thereof.

Adjacent the smaller expanded section 112 and between that section and the end wall 103 is a groove 117, as viewed from the inside, which is continuous along the inside of the top wall 101, the side wall 100 and the bottom wall 102. Outside of the cover opposite groove 117 is a ridge 118 across those walls.

Figure 4:
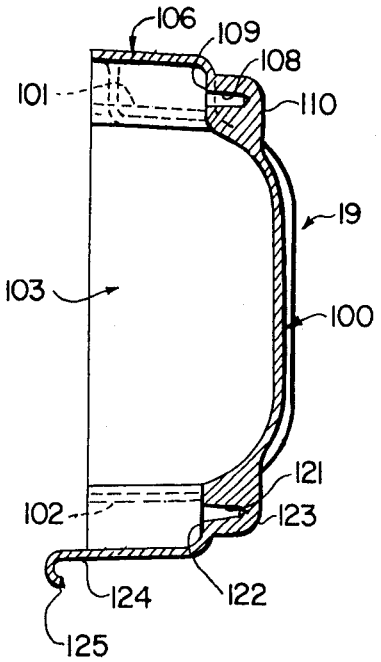
FIG. 4 is a rear elevational view in section taken along lines 4—4 in FIG. 3 of the capacitor cover.

In the bottom wall 102 opposed from the chamber 106 is a similarly formed lower protruding chamber 120 having an internally threaded bore 121 in a vertical wall 122 of the chamber, that bore extending into a flange 123 adjacent wall 122. As seen in FIGS. 1 and 4, extending from the bottom part of the lower chamber 120 is an arm 124 having a curved distal end 125, the curve being substantially U-shaped and curving backwardly away from the interior of the capacitor cover 19.

The ballast cover 21 as seen in FIGS. 1 and 2 comprises a top wall 128, a bottom wall 129, a side wall 130, an end wall 131 and an end wall 132, all of these walls but for the side wall 130 having a continuous flange 133 at their distal edges, the flange having four bores, one in each corner.

The lamp socket 23 is located below the bottom of the central housing 14 between the legs 94 and has the lamp 24 extending downwardly therefrom. Below the legs 94 is the reflector 26 having spring-steel connectors 134 extending therefrom, these connectors having slots 136 at their upper distal ends for reception on the L-shaped projections 96 on each leg 94.

ASSEMBLY OF THE LUMINAIRE

As seen in FIGS. 1 and 2, all of the components described above are united in an assembly forming the completed luminaire. Top cover 12 is pivotally coupled to the top of the central housing 14 which has been formed from the first and second parts 16 and 17 coupled together by screws 58 and 59, as described above. This pivotal coupling is provided by, as seen in FIG. 2, interposing a pin 139 through the internal bores 46, 47 and 48 of the top cover's flanges 43, 44 and 45 as well as through the horizontal bores 79 and 80 in the two adjacent brackets 76 and 77 on the two parts 17 and 16. This pivotal coupling further includes a threaded eye bolt 141, as seen in FIGS. 1 and 2, which is pivotally coupled to the central housing by means of a pin 143 passing through the eye of the eye bolt 141 and also passing through the horizontal bores 79 and 80 of the other set of brackets 76 and 77 on the two joined parts 16 and 17 forming the central housing 14. On the threaded distal end of the eye bolt 141 is a wing nut 145 which provides a releasable coupling of the end of the top cover 12 by means of the eye bolt 141 being received in slot 41 in the forked bracket 40 on the top cover, with the wing nut 145 being threadably engaged down onto the top of that forked bracket. In order to gain access to the inside of top cover 12, where splicing of the power cable 30 can take place, all that is necessary is to loosen the wing nut 145 and swing the eye bolt 141 out of the forked bracket 40. By varying which of the bracket elements 42, 42*a*, 42*b* and 42*c* and flanges 43, 44 and 45 are used, the location of the top cover relative to the housing can be selected to properly balance the luminaire in view of the size and weight of the ballast used therein.

To insulate the cover from the housing an insulating sheet 147 is located therebetween, as seen in FIGS. 1 and 2, which has a central aperture 148 for receiving wires passing therethrough.

On the left hand side of the central housing 14 in FIG. 1, the capacitor cover 19 is shown having therein a capacitor 20 which has an end rim 149 located in the depression 117 in wall 100 of the capacitor cover 19. The capacitor is secured against that wall 100 by means of a bracket 151 and screws 152 and 153 passing through suitable bores in the bracket and being received respectively in threaded bores 108 and 121 in the capacitor cover flanges 110 and 123, as best seen in FIG. 1.

In order to pivotally mount the capacitor cover 19 and the capacitor 20 contained therein to the central housing 14, the curved distal end 125 on arm 124 at the bottom of the capacitor cover is maneuvered through aperture 95 in leg 94 of central housing part 17 and the capacitor cover is pivoted upwardly and towards part 17. To mount the top of the capacitor cover to the part 17 a screw 155 is passed through bore 114 in chamber 112 of the capacitor cover which is threadedly received in bore 74 provided in wall 61 of part 17. In order to gain access to the capacitor 20, screw 155 is released and the cover pivoted outwardly along the hinge formed by curved distal end 125 on arm 124 at the bottom thereof.

As seen in FIG. 1, a starter 157 for the lamp 24, used when the ballast is of a high pressure sodium type, is located inside central housing part 17 and is accessible upon outward pivotal movement of the capacitor cover 19 via aperture 67 in the side wall 61 of part 17.

On the right hand side of FIG. 1, the ballast core 160 is shown mounted to the side wall 61 of central housing part 16 which is opposite to the capacitor mounting. The ballast is mounted by means of four screws 162 which pass through the four bores in flange 133 of the ballast cover 21, extend completely through the four corners of the ballast core 160 and penetrate the side wall 61, being received in respective bores 68, 69, 70 and 71 in that wall 61 of part 16. Suitable nuts 163 secure those screws in place. As seen in FIG. 1, the windings 165 of the ballast 22 are received on the right hand side in ballast cover 21 and on the left hand side in the internal cavity formed by part 16 of the central housing. These windings 164 enter part 16 via rectangular aperture 67 formed in that part. Thus, a major portion of the ballast is outside of the housing and minor portion is inside. The ballast 22 is readily removed from its mounting with the central housing 14 by means of removal of four screws from the ballast core 160. To insulate the ballast from the central housing an insulating sheet 168 having a central cut-out for the ballast is interposed between side wall 61 and ballast 22 as seen in FIGS. 1 and 2. Outwardly folded flaps 169 are adjacent windings 165, these flaps being folded out of the sheet.

As seen in FIG. 1, the lamp socket 23 is releasably coupled to the bottom of the central housing 14 by means of two screws 167 which pass through the circular recesses formed in the two bottom walls 63 of the two parts 16 and 17 via the four semi-circular recesses 98, 98 and 99, 99 as seen in FIG. 7.

An alternate mounting for the cover 12 is shown in FIG. 8 in which a threaded conduit 172 is threadable received directly into a threaded aperture 49 in cover 12. A set screw 173 is received in a threaded bore 174 in the second side wall 39 of cover 12 as seen in FIGS. 5, 6 and 8. The same cover 12 can be used for this mounting as that shown in FIG. 1 with a mere rotation of the cover through 180°. The flexible mounting shown in FIG. 1 is especially useful in areas prone to earthquakes, while that shown in FIG. 8 is useful where a rigid mounting is desired. In each case, whether the mounting if flexible or rigid, this mounting or suspension is the sole load bearing element interconnecting the luminaire assembly and the fixed support, as clearly seen in FIGS. 1 and 8.

While various advantageous embodiments has been chosen to illustrate the invention, it will be understood by those skilled in the art that various changes and modifications can be made therein without departing from the scope of the invention as defined in the appended claims.

What is claimed is:

1. A luminaire assembly comprising:

a central housing having a lamp socket extending downwardly therefrom;

a capacitor;

first means for mounting said capacitor on one side of said housing and externally thereof;

a ballast;

second means for mounting said ballast on a side of said housing opposite said capacitor with a major portion of said ballast being outside of said housing;

a top cover;

means for coupling said top cover to the top of said housing; and means for suspending said luminaire assembly from a fixed support, said means for suspending being located on said top cover laterally displaced towards said ballast and engaging the fixed support substantially above the center of gravity of said luminaire assembly, said means for suspending being the sole load bearing element interconnecting said luminaire assembly and said fixed support.

2. A luminaire assembly according to claim 1, wherein said means for suspending includes a hook and said fixed support includes an eye engageable with said hook.

3. A luminaire according to claim 1, wherein
said means for coupling said top cover to said housing includes
means for pivotally coupling one portion of said housing to said top cover, and
means for releasably coupling another portion of said housing to said top cover.

4. A luminaire according to claim 3, wherein
said means for pivotally coupling comprises a pin and at least two bored brackets.

5. A luminaire according to claim 3, wherein
said means for releasably coupling comprises a threaded rod having a wingnut receivable thereon and a forked bracket.

6. A luminaire according to claim 1, wherein
said central housing is formed from two identical parts.

7. A luminaire according to claim 1, wherein
said first means for mounting said capacitor includes a capacitor cover, an arm supported on said capacitor cover having a curved distal end and an aperture in said central housing for receiving said curved dital end.

8. A luminaire according to claim 1, wherein
said central housing has an aperture in one wall thereof for permitting a minor portion of said ballast to protrude into said central housing.

9. A luminaire according to claim 1, wherein
said means for mounting said capacitor includes a capacitor cover attached to said housing, and
said central housing has an aperture in one wall thereof providing direct communication between the interior of said central housing and the interior of said capacitor cover.

10. A luminaire according to claim 1, wherein
said top cover has an aperture therein adapted to receive a power cable.

11. A luminaire according to claim 1, wherein
said means for suspending comprises a threaded aperture in said cover, and
said fixed support includes a threaded conduit received in said threaded aperture.

12. A luminaire according to claim 1, wherein said means for coupling said top cover to said housing includes
means for pivotally coupling one portion of said housing to said top cover at a plurality of locations, and
means for releasably coupling another portion of said housing to said top cover at a plurality of locations.

13. A luminaire according to claim 1, and further including
insulation means located between said top cover and said housing.

14. A luminaire according to claim 1, and further including
insulation means located between said housing and said ballast.

* * * * *